US005385337A

United States Patent [19]

Schultz

[11] Patent Number: 5,385,337

[45] Date of Patent: Jan. 31, 1995

[54] CONTROL SYSTEM FOR A SOFT VACUUM FURNACE

[75] Inventor: Thomas J. Schultz, Maumee, Ohio

[73] Assignee: Gas Research Institute, Chicago, Ill.

[21] Appl. No.: 48,680

[22] Filed: Apr. 19, 1993

Related U.S. Application Data

[62] Division of Ser. No. 816,604, Dec. 31, 1991, Pat. No. 5,261,976.

[51] Int. Cl.[6] ..... C21D 1/773

[52] U.S. Cl. ..... 266/81; 266/87

[58] Field of Search ..... 266/81, 87; 432/37

[56] References Cited

U.S. PATENT DOCUMENTS

| | | | |
|---|---|---|---|
| 3,534,143 | 10/1970 | Carlson et al. | 266/87 |
| 4,565,561 | 1/1986 | Gagne | 73/23.31 |
| 4,606,807 | 8/1986 | Mendenhall | 204/409 |
| 5,106,201 | 4/1992 | Neuhaus | 266/87 |
| 5,225,142 | 7/1993 | Heilmann et al. | 266/87 |

FOREIGN PATENT DOCUMENTS

| | | | |
|---|---|---|---|
| 56-13430 | 2/1981 | Japan | 148/508 |
| 56-102518 | 8/1981 | Japan | 148/508 |

OTHER PUBLICATIONS

GRI Report #08/0159 titled "High Temperature Indirect-Fired Furnace Development-Phase I, Final Report Nov., 1986-Apr. 1988" dated Oct. 7, 1988: Excerpb, pp. i, iii 1-3, 5, 9, 16-19, 26-29, 33, 52-55, 67, 68; App 2: 2-10; 2-31-84; 3-1-9.

Metals Handbook, 9th Edition, vol. 4, Heat Treating; pp. 307-309, 312; 365-366.

Metallurgia and Metal Forming, Dec. 1972-Jan. 1973; "Control of Carburizing Furnace Atmospheres Using Oxygen Potential Measurements" pp. 413-416; 19-23.

G. Hart, "Standard Free Energy of Formation of Oxides as a Function of Temperature" from F. D. Richardson c/o T. H. E. Jeffies., T. Iron Steel Inst., 160, 261 (1948).

*Primary Examiner*—George Wyszomierski

*Attorney, Agent, or Firm*—Frank J. Nawalanic

[57] ABSTRACT

A control arrangement is disclosed for a conventional, atmosphere heat treating furnace which is operated at high temperature and fitted with a vacuum pump to draw rough or soft vacuum levels when heating the work to heat treat temperatures. The control arrangement utilizes a hydrogen—inert gas furnace atmosphere continuously metered into the furnace to produce a reducing gas mixture to prevent oxidation of the work. If oxidation conditions are sensed, the mass flow is automatically increased while vacuum levels are maintained constant. A unique oxygen probe mounting arrangement is disclosed which enables a conventional oxygen probe to give fairly accurate and consistent readings for fast, automatic process control.

7 Claims, 3 Drawing Sheets

CONTROL SYSTEM FOR A SOFT VACUUM FURNACE

This is a division, of application Ser. No. 816,604 filed Dec. 31, 1991 now U.S. Pat. No. 5,261,976.

This invention relates to a control arrangement for an industrial heat treating furnace, and more particularly to an industrial heat treating furnace which is capable of operating at "soft" or rough vacuum levels as well as at standard atmosphere or positive pressures.

The invention is particularly applicable to a control arrangement in which heat treating processes are performed wherein the case or surface of the work is not hardened by the addition of alloying elements from a gas such as carburizing, nitriding etc. and will be described with particular reference thereto. However, from a conceptual viewpoint, the invention may have application to certain heat treating case hardening processes.

BACKGROUND

1.) General Discussion

Within the industrial heat treat art, industrial heat treat furnaces can be broadly classified as being either vacuum furnaces or atmosphere furnaces. Procedurally the manner in which heat treat processes are performed in vacuum furnaces is fundamentally different than the manner in which heat treat processes are performed in atmosphere furnaces. In atmosphere furnaces the work is immersed in a gaseous furnace atmosphere which is controlled at temperature, composition, flow rate, etc. so that gas reactions will proceed to equilibrium in a manner which permits the work to undergo whatever phase transformation or alteration is desired to achieve the specific heat treat process. In vacuum furnaces, the furnace atmosphere is removed by a vacuum pump and the work heated to the desired temperature to effect the heat treat process. Both furnaces then use similar mechanisms to quench or cool the work. Both furnaces purge the furnace chamber during preheat of the work. The furnaces differ during that portion of the heat treat process where the work is heated to its heat treating temperature.

Although it is difficult to make any general statements in this area, almost all heat treat processes can be performed in a vacuum furnace, although not all heat treat processes can be performed in atmosphere furnaces and for certain heat treat processes, vacuum furnaces inherently produce better or more closely controlled heat treated product. On the other hand economics dictate use of atmosphere furnaces in terms of capital cost, throughput, capacity, operating costs etc. For both furnace types, continuing efforts are being made to more closely control the heat treat process to improve product quality.

Vacuum furnaces are typically constructed with a double wall steel casing containing a water jacket therebetween in a pressure vessel configuration with doors sealed by water cooled elastomer seals so that a fine or hard vacuum can be drawn within the vessel. Because of sealing requirements, cold wall vacuum furnaces are universally electrically heated by graphite heating elements which traditionally increase energy costs when compared to gas fired burners. In contrast, atmosphere furnaces are typically constructed with a single $\frac{1}{8}''$-$\frac{1}{4}''$ thick steel casing to which is attached blanket insulation i.e. a hot wall design. As explained in the chapter entitled "Vacuum Furnace" set forth in Volume 4, "Heat Treating" of *Metals Handbook*, Ninth Edition, there are hot wall vacuum furnaces. These furnaces employ a retort, usually cylindrical in configuration, through which a vacuum is pulled and the retort is inserted into a refractory lined atmosphere type furnace. However, standard construction techniques for today's atmosphere type furnaces produce a sufficiently "tight" furnace to permit a soft or slight vacuum to be drawn or pulled in such furnace, and this is the furnace to which the present invention relates. The furnace to which this invention relates can be classified as a "hot wall" vacuum furnace but is differentiated from conventional hot wall vacuum furnaces in that no retort is used.

Traditionally gas fired atmosphere furnaces have been limited to processing temperatures of 1850° to 1900° F. although recent integral-quench technology developed by Surface Combustion, Inc. under funding from Gas Research Institute has extended that capability to temperatures up to about 2050° F. and is practiced in Surface's UltraCase furnace. There is however, an increasing range of materials that require processing above 2050° F. This range includes tool and die steels, heat resistant alloys, powder metals and a wide range of structural ceramics and composites. Such materials which require processing at temperature ranges of from 2050° F. to 2350° F. are currently processed, until the present invention, in vacuum furnaces. The only other viable alternative is heat treating in molten salt baths which is gradually becoming cost prohibitive because of environmental concerns.

With respect to the control systems now in use for vacuum furnaces for non-case hardening processes, because of the hard or fine vacuum, the oxygen content of whatever residual gas remains in the furnace, if converted to water vapor, would produce lower dew points then that achieved in atmosphere furnaces with inert or reducing gas atmospheres. Thus as a general concept, control of vacuum furnaces during the heating stage is simply one of time and temperature established in advance at vacuum levels which will not produce a vapor pressure which will draw alloying elements out of the workpiece. Of course prior to heating, the vacuum chamber is purged with an inert gas and after heating, cooling is effected by conventional practices common to both atmosphere and vacuum furnaces. While this is the general control scheme, heat treating is an advanced art and there are vacuum furnace installations for certain heat treat processes where the vacuum is reduced to avoid vaporization. This has been accomplished by means of a gas such as nitrogen which is injected in small quantities into the vacuum vessel by a needle valve. This deliberate leaking of gas raises the pressure within the vacuum furnace to some stable level between the ultimate vacuum of the pumping system and atmospheric pressure. For example, the vaporization of copper during the brazing of heat exchangers is suppressed by the leaking of nitrogen into the furnace and maintaining the vessel at a vacuum level of 0.27 kPa (2.0 torr). This is typically an intermittent operation.

In performing case hardening heat treat processes with vacuum furnaces, typically carburizing, a carbon bearing gas such as methane, is introduced into the furnace while the work is heated in a vacuum. Typically, a fixed quantity of methane is metered into the furnace over a pre-established time period, and then stopped while the work is maintained at the carburizing temperature or soaked prior to being quenched. In some processes the methane content of the gas pulled from the furnace by the vacuum pump is analyzed by a Residual Gas Analyzer to determine how much carbon has been deposited on the case. There is no dew point or oxygen reading and there is no continuous sampling of furnace gas because there is no component of the gas within the furnace to which the reading can be compared. In some instances, vacuum carburizing is performed by metering methane with a carrier gas i.e. nitrogen which, after it is drawn out of the furnace, is enriched with methane and recycled back into the furnace in a closed loop system. The content of the spent gas may be analyzed prior to enriching with "makeup" methane by various gas sampling techniques which would compare whatever was sensed in the vacuum stream with an ideal methane-inert gas composition to add the desired methane. Outside of these "exceptions" the general control scheme for a vacuum furnace is simply time, temperature and vacuum levels. In addition, while the work is being heated i.e. preheat, conventional practice is to purge the vessel with a backfill of an inert gas such as nitrogen or argon. Normal practice is to backfill the vessel with nitrogen, while the work is being heated and then pump the vessel down to a fine vacuum and repeat the backfill for about 5 to 10 purges of the furnace.

Control schemes for atmosphere furnaces are different than for vacuum furnaces. In non-case hardening processes, the general control concept is, after purging, to continuously inject, at a somewhat constant mass flow rate, a treating gas. The gas within the furnace is then analyzed by various devices such as a $CO_2$ analyzer to determine the partial pressure of the sensed gas which reacts with other gases in the furnace to reach equilibrium. Depending upon the readings a "scavenger" gas or (gases) is then introduced into the furnace to readjust the equilibrium balance of the gases. Insofar as the present invention is concerned, it is conventional practice to use a neutral or inert gas such as nitrogen or argon to which an enriching gas such as hydrogen is added to produce an enriching atmosphere within the furnace for certain heat treat processes. Dry hydrogen atmospheres are used in the annealing of stainless and low carbon steels, electrical steels, several non-ferrous metals, powdered metal parts, sintering and brazing applications among others. Nitrogen hydrogen atmospheres have been used in brazing, and sintering and annealing applications although not necessarily at the mixture ratios of the present invention. Further, conventional control technique is to maintain the flow rate of the neutral gas somewhat constant. When the enriching or scavenger gas is added to the neutral gas there is an increase in the overall flow rate of the atmosphere within the furnace.

2.) Gas Research Institute Work

This invention was developed under a project sponsored by the assignee, Gas Research Institute, and undertaken by Surface Combustion, Inc. Gas Research Report 88/0159 entitled "High Temperature Indirect-Fired Furnace Development—Phase I", authored in part by the inventor, discusses the concepts utilized in a soft or rough vacuum furnace. Reference should be had to that report for a more detailed discussion of the various heat treat processes which are theoretically capable of being performed in a soft vacuum furnace.

The Gas Research report generally verifies that within the soft vacuum ranges defined herein and at high temperatures specified herein it is technically feasible to perform non case hardening heat treat processes with a controlled atmosphere of nitrogen along with a blend of 1 to 5% hydrogen. Heat treat processes discussed in the report included tool steel hardening, annealing stainless steel, brazing, solution annealing and sintering powdered metal parts. With the exception of annealing stainless steel, the control arrangement set forth herein is applicable to the heat treat processes identified in the GRI report as well as other processes.

The GRI concept report discussed possibly operating the furnace at partial pressure and simultaneous purging with a flowing atmosphere or alternately pumping and purging. A suggested cycle included the step of continuously supplying process atmosphere ($N_2$ with 5% $H_2$) to the hot zone at a rate of 50 SCFH. Control was suggested by a Residual Gas Analyzer utilizing mass spectrometry to indicate levels of oxygen and water vapor or other contaminants in the furnace with the signal being used for alarm, control/sensor etc.

3.) Measuring Instruments

There are numerous instruments for measuring gas compositions. The Residual Gas Analyzer discussed in the GRI report is not practical for commercial application as the furnace control because of cost and time to complete the analysis. This applies to all other mass spectrometry type measuring instruments. Dew point analyzers directly measure the water vapor which is one of the principal elements to be controlled. However, the temperature at which the furnace operates and the temperature at which the sample is taken results in condensation making it difficult to correlate, for the processes under discussion, the dew point of the gas within the furnace. $CO_2$ analyzers are not applicable because, for the processes under discussion, there is no carbon in the atmosphere. Thus by the process of elimination, oxygen probes are left.

Oxygen probes are, perhaps, the most recently developed instrument in the heat treat field. Generally the probe consists of two platinum electrodes separated by a solid electroyte usually in the form of a gas tight zirconia tube. Ambient air at the inside of the tube is in contact with one electrode while the furnace atmosphere is in contact with the other electrode vis-a-vis the outside of the tube. The differences in oxygen content induces an EMF which is correlated by well known equations, i.e. Nernst equation, to determine the partial pressure of oxygen present in the furnace atmosphere. The relationships hold fairly consistent up to temperatures of about 1900° F.

Oxygen probes are universally used in the heat treat field for two applications. First, the oxygen probe is widely used to control atmosphere carburizing. The probe application is both in situ and ex situ. See "Control of Carburizing Furnace Atmospheres Using Oxygen Potential Measurements", *Metallurgia and Metal Forming*, Dec., 1972; Jan., 1973 pages 413–416; pages 19–22. Oxygen probes are also widely used to control external, endothermic gas generators. Atmosphere carburizing typically takes place between 1500°–1800° F. which is well within the temperature range of such probes. Ex situ gas generator applications are at substantially lower temperatures and at least one ex situ oxygen probe application uses a heater surrounding the probe to raise probe temperature to improve the probe readings. See Mendenhall 4,606,807. In endothermic gas generators it is important to drop the temperature of the endothermic gas to below about 400° F. so that carbon will not form as the endothermic gas is transported from the generator to the furnace. When the gas sample is taken, ex situ, the probe readings are not consistent at the lower temperatures. Thus it is known to increase the temperature around the probe so that consistent oxygen probe readings can be taken.

While it is not possible to state with any degree of certainty what has or has not been done in the heat treat area, it is not believed that oxygen probes have been successfully used heretofore in vacuum applications for the heat treat processes under discussion. There are several reasons for this belief. First, from the discussion above, the vacuum vessel is simply pumped down. Thus there would not be any reason to sense atmosphere. Second, in those instances where the vacuum is lessened, the gas supplied is inert. Outside of such reasons, the oxygen probe, because of the pressure differential between the electrolyte tube can and may leak oxygen especially at the finer vacuum levels. Conceptually, it is not known whether this is or is not a function of electrolyte tube design. For soft vacuum application, one commercially available oxygen probe has been found by testing done by Linde not to deleteriously leak oxygen. Secondly, and more significantly, for in situ applications, the temperatures at which the furnace employing the invention is operated at will effect the electrodes rendering the probe useless.

SUMMARY OF THE INVENTION

Accordingly it is a principle object of the invention to provide a control system for a conventional atmosphere furnace construction which is operated at high temperature under a soft vacuum to perform certain heat treat processes.

This object along with other features of the invention is achieved in a process for heat treating ferrous and non-ferrous work in a conventional, hot wall, standard atmosphere construction furnace equipped with a vacuum pump. The process includes the steps of drawing a vacuum in the furnace from about 1 to 400 torr; heating the work in a furnace to temperatures in excess of 2050° F.; metering a constant mass flow rate of inert gas having a predetermined percentage of hydrogen into the furnace to produce a furnace atmosphere while maintaining the vacuum at the levels indicated; sensing the oxygen content of the furnace atmosphere by drawing a portion of the furnace atmosphere outside of the furnace, reducing the temperature of the withdrawn portion to a temperature capable of being sensed by an oxygen probe and correlating the oxygen probe readings to the partial oxygen pressure in the furnace, and increasing the mass flow rate of the gas when the oxygen content exceeds a predetermined value while simultaneously increasing the pump's output to maintain the vacuum within the range of 1 to 400 torr and decreasing the mass flow rate to the predetermined constant mass flow rate when the oxygen content drops below the predetermined level whereby the work is heat treated with minimal oxidation. Preferably, the hydrogen content does not exceed 2% of the total mass flow of the inert gas which is preferably either nitrogen or argon and during increased flow of the furnace atmosphere, the hydrogen content does not increase to a level beyond 4% of the nitrogen gas admitted to the furnace.

In accordance with another feature of the invention the gas is pulled through a duct by the vacuum pump with the gas being cooled in the duct by the duct being in contact with ambient atmosphere so that the temperature of the furnace atmosphere drops to temperatures lower than 1900° F. Within the duct a sample of the furnace atmosphere is funneled into an enclosure having an inlet and an outlet and the sample within the enclosure is heated to a predetermined temperature and the oxygen content of the sample within the enclosure is sensed to obtain an oxygen content of the sample which is closely correlatable to the oxygen content of the furnace atmosphere within the furnace whereby accurate control of the process can be achieved. Preferably the predetermined temperature within the enclosure is about 1900° F. and the sample passes through a tortuous, funnelled path to achieve a steady state, low flow rate of the gas sample within the enclosure for consistent oxygen probe readings with little if any threat of outside air leakage in an amount which distorts the probe's working.

It is another object of the invention to provide a control system (method and apparatus) which is capable of accurately and quickly controlling a heat treat process performed, at least partially, in a vacuum.

It is yet another object of the invention to provide a control arrangement which permits heat treat processes in the temperature range of 2050° F. to 2375° F. to be performed in standard atmosphere construction, hot wall, heat treating furnaces.

Still another object of the invention is to provide an oxygen probe arrangement for controlling a heat treating process performed in a vacuum whereby accurate and consistent probe readings are obtained for controlling the process.

Still another object of the invention is to provide a control arrangement for a vacuum heat treat furnace which can be simply installed and economically monitored to provide continuous control of the heat treat process.

Yet another object of the invention is to provide a controlled arrangement for a vacuum heat treat furnace which permits one or more of the following heat treat processes to be controlled:

(a) hardening of tool steel;
(b) annealing of select steels;
(c) sintering;
(d) sintering of powdered metal parts;
(e) solution annealing;
(f) brazing, soldering, etc.; and
(g) annealing and/or hardening of select non-ferrite metals.

Yet another object of the invention is to provide a control scheme for a vacuum furnace which is able to continuously monitor the heat treat process and automatically control the process to achieve close metallurgical control of the heat treated work.

Still yet another object of the invention is to provide a control scheme for a heat treat process which uses less gas to heat treat a work piece than conventional atmosphere furnaces while maintaining similar capacity, throughput rates and construction costs as conventional atmosphere furnaces.

A still further object of the invention is to provide an oxygen probe arrangement for select heat treat processes which is better able to withstand unavoidable oxygen leakage while maintaining fairly consistent probe readings.

Still further objects and features of the invention will become apparent to those of ordinary skill in the art upon reading and understanding the description of the preferred embodiment of the invention set forth below.

BRIEF DESCRIPTION OF THE DRAWINGS

The invention may take form in certain parts and arrangement of parts, a preferred embodiment of which will be described in detail here and illustrated in the accompanied drawings which form a part hereof and wherein:

FIG. 2 is a graph illustrating conventional vacuum ranges at which conventional vacuum heat treating furnaces are operated at;

FIGS. 2, and 3 are reproduced from Volume 4, "Heat Treating" of *Metals Handbook*, Ninth Edition.

DETAILED DESCRIPTION OF THE PREFERRED EMBODIMENT

Figure 1:
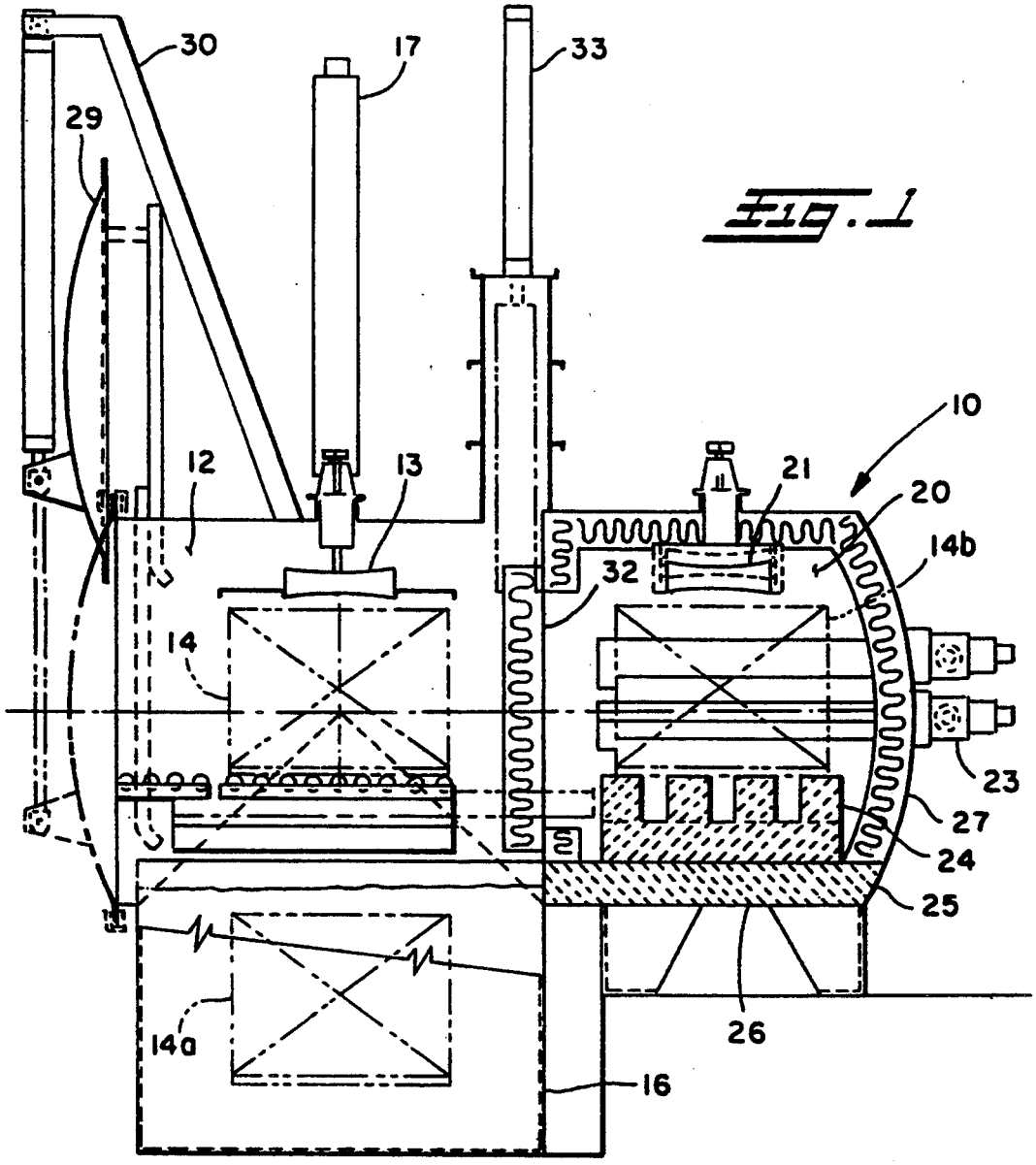
FIG. 1 is a general, schematic, elevation view, partially in section, of a two chamber hot wall, standard atmosphere type furnace with integral quench.

Referring now to the drawings wherein the showings are for the purposes of illustrating a preferred embodiment of the invention only and not necessarily for the purposes of limiting same, there is shown in FIG. 1 a two chamber standard atmosphere furnace with integral quench 10.

Furnace 10 as illustrated includes a vestibule 12 with a high speed fan 13 for cooling work 14 indicated by dot-dash lines which typically are placed loose in trays. Furnace 10 also has an integral quench tank 16 which, by means of a conventional pneumatic or hydraulic cylinder 17 can lower work 14 positioned on a rotatable roller rail arrangement 18 into quench tank 16 for cooling work 14 and for illustrative purposes work 14a is shown positioned within quench tank 16. Adjacent vestibule 12 is heat chamber 20 to which a vacuum pump, not shown in FIG. 1, is attached. Heating chamber 20 has a fan 21 for positive pressure, convective preheat of work **14*b* when positioned therein. Also, for furnace 10 gas-fired radiant heat tubes 23 are illustrated as the source of energy for providing heat to heat chamber 20. Alternatively, electric heaters can be used. In the arrangement illustrated, work 14*b* rests on a ceramic refractory hearth 24, which in turn rests on conventional insulated furnace refractory 25 secured or fastened to furnace casing 26 in a conventional manner. The remainder of the insulation is a conventional fibrous insulation which can either be graphite felt or a Kaowool blanket covered with Nextel fiber. The insulation is mounted to casing 26 with conventional anchors and studs. This is a conventional hot wall standard atmosphere or positive pressure furnace design. At the operating temperatures discussed herein, temperature of furnace casing 26** will be anywhere from 140° up to 200° F. Conceptually, a water jacket can be employed although, for cost consideration purposes, a water jacket is not required.

Furnace casing 26 is cylindrical for heat chamber 20 and vestibule 12 and quench tank 16 is rectangular. End wall 27 of heat chamber 20 is spherical. All welds are gas-type so that a vacuum can be drawn throughout the entire furnace at the levels discussed herein. The only opening to furnace 10 is at vestibule 12 and a spherical door 29 actuated by a conventional cammed door operator 30 is used to raise and lower door 29. The cammed door actuator cams door 29 into sealing engagement with furnace opening and conventional rope seals are contemplated to be sufficiently effective to seal the furnace at the vacuum levels used herein. Alternatively, an elastomer seal with a water jacket can be employed to seal the door although it is not contemplated that such a seal arrangement will be required.

An insulated inner door 32 actuated by a pneumatic or hydraulic cylinder 33 thermally seals vestibule 12 from heat chamber 20 but inner door 32 does not maintain a vacuum seal between heat chamber 20 and vestibule 12. As thus far described, furnace 10 is somewhat conventional.

This invention utilizes an oxygen probe to measure the partial pressure of oxygen i.e. $PO_2$ in the furnace gas and uses that for control. There are several differences between the mode of control used in this invention and that used in other atmospheric furnaces. In control of a carburizing furnace, it is assumed that the gas analysis is in equilibrium with the metal and that the percent $CO_2$ or dew point is a measure of the amount of carbon on the surface of the work in the furnace. That is, there is a range of possible dew points that correspond to different surface carbons possible at a given temperature. Control of the dew point of a carburizing furnace is achieved by changing the rate of natural gas (enriching gas) which is added to the furnace atmosphere. This changes the surface carbon of the work and results in a change in the dew point of the atmosphere gas. In this case, the gas analysis (dew point) is a measure of the condition of the metal surface, but the condition of the surface is set by the enriching gases. Thus an oxygen probe reads the level of oxygen in equilibrium with the $H_2$ to $H_2O$ ratio and is then used to infer that ratio and through it the percent carbon on the surface of the metal. This is because the gas is in equilibrium via the water/gas shift reaction which sets the relative amount of $H_2O$ and $CO_2$ in the gases by changing the amounts of $H_2$ and CO. The oxygen level is reducing to metal at all times. The temperature of the furnace is limited to about 1800° F. so that the oxygen probe can be placed directly in the furnace chamber. The furnace pressure is at one atmosphere and therefore does not change the measurements. The atmospheric pressure operation also supplies enough gas to reassure that there is a sufficient sample of gas flow to the end of the probe, and the small amount of $O_2$ diffuses through the probe and the atmosphere does not contaminate the sample. The normal carbon range is between 30° F. and 60° F. dew point with an $H_2$ concentration of about 40%. This corresponds to an $H_2/H_2O$ ratio of 25 to 100, and at about 1800° F. the corresponding oxygen probe reading would be about 1050 to 1130 mv readings. In contrast the present invention is looking for ratios of the order of 1,000 to 3,000 or 4,000. It is this difference which requires that no oxygen leakage be present. In ex situ applications a small pressure tap i.e. $\frac{1}{4}$ or $\frac{3}{8}$" line draws furnace atmosphere from the furnace and then ports the atmosphere back into the furnace. Since the system is at atmospheric pressure, sealing of the small lines can be done. However, if there is any minute leakage of oxygen in the tap line, the relatively high $H_2/H_2O$ ratio indicates some tolerance to withstand the leakage. In the vacuum furnace under discussion, the very low $H_2/H_2O$ ratio has no tolerance for leakage, and if one one thousandth ppm of oxygen leakage occurs, the probe readings are fouled. This is because of the sample size in the line to begin with. Because of furnace vibration, etc. it is really not possible to vacuum seal such small lines to the leakage requirements needed.

The situation is different when attempting to control the atmosphere furnace under the rough or soft vacuums disclosed herein. In the first place, the gases contain no carbon so there is no water/gas shift reaction to be in equilibrium, and the $H_2/H_2O$ will not change in response to the temperature or the surface carbon of the work. The sired gas analysis is simply one in which the gases are reducing to the metals in the furnace and there is no oxide formation on the metals. If the gas is in equilibrium with the metal, it is not positive that the metal is not being oxidized. Likewise, if oxidized metal is being reduced by the gases, the gas would again be in equilibrium with the metal. The oxygen probe measures the oxygen partial pressure which is equal to the volume percent oxygen times the total pressure. With this measurement, the gases can change from oxidizing to reducing simply by changing the total pressure without changing the parts per million oxygen level in the furnace gases. However, it has been determined that pressure, within the limits of the vacuum disclosed herein, at the temperature ranges in the order of 2050°-2350° F. is not critical to the control.

When the furnace work is at a temperature where oxidization is rapid i.e. at the high temperature portion of the heat treat process, this invention utilizes a controller which will make judgements as to the best way to control the particular cycle for that material. The controller will make the decision which will balance the need for more $H_2$versus operating at a lower pressure. For example, if the atmosphere has an oxygen partial pressure of $10^{-15}$ in the gas with a corresponding $H_2/H_2O$ of 500 and it is desired to operate with an $H_2/H_2O$ ratio of 1,000, one could assume that if the furnace pressure is decreased from 0.01 to 0.001 atmospheres, it would be expected that a corresponding change in the partial pressure of oxygen $PO_2$ and a resulting change in the ratio of $H_2/H_2O$ would occur. However, this is in fact not what occurs. There are only three types of atoms of interest in the furnace. They are at equilibrium and changing one will result in a change in the other two. Reducing the pressure reduces the $PO_2$ which is proportional to the $H_2/H_2O$ squared. By equilibrium, the reaction should shift so that more $H_2O$ is converted to $O_2$. However, there is such an overwhelming difference in the magnitudes of the oxygen and $H_2O$ that an imperceptible change in the water vapor will increase the $O_2$ back, to its original level. Thus, changing the pressure will not change the oxidant potential of the gaseous atmosphere. This holds for both increasing and decreasing pressure. The only way to change the oxygen potential is to reduce the total amount of oxygen in the gas i.e. the sum of $H_2O$ plus $O_2$. This happens as more gas is added to the atmosphere if the supply gas has a lower oxygen level than that in the furnace. If there is a fixed rate of oxygen leakage into the furnace, the only way to control the $H_2/H_2O$ ratio is to have a minimum gas flow rate. If the purged gas rate is above that minimum, then the $H_2/H_2O$ will be acceptable. This will be determined by the reading of the oxygen probe. Percent hydrogen in the purged gas is really only a minor contributor and can be used for a "trim" control with the primary control being the flow rate of the atmosphere gas. That is because the $H_2/H_2O$ Will respond very slowly to changes in the $H_2$ content because of the large volume of the furnace relative to the slow rate of the gas. Flow rates contemplated are between 50 and 500 standard cubic feet per hour at vacuum levels between 10 and 760 torr.

Stating all this in another way, there are three reactions of concern.

The first reaction:

$Fe+H_2O \rightleftarrows FeO+H_2$ is a reversible reaction.

The second reactions $H_{2+}\frac{1}{2}O_2 \rightleftarrows H_2O$ is also a reversible reaction.

The third reaction is written as the sum of one and two:

$Fe+\frac{1}{2}O_2 \rightleftarrows FeO$ is a reversible reaction.

As is well known in the heat treat field the entropy of these reactions is expressed as $\Delta G^\circ = RT \text{ In } PO_2$ (Kcal) and certain reactions at a given temperature will proceed to form oxides more readily than others. Reference should be had to the graph of standard free energy of formation ($\Delta G$) of oxides as a function of temperature published by F. D. Richards, and H. E. Jeffer, *J. Iron Steel Inst.,* 160, 261 (1948) modified by L. S. Ducken and R. W. Garry, *Physical Chemistry of Metals,* McGraw-Hill, N.Y., 1953 which chart is incorporated by reference herein. This chart, because of its log scales, etc. is not duplicated as a drawing herein, but those skilled in the art are well aware of the chart and it is believed sufficient to the discussion of the invention to simply note the chart and incorporate it herein by reference. The chart is based on steady state conditions, but for discussion purposes, the kinetics of the reactions can be discarded. Basically the chart verifies that what the control system is doing at the desired temperatures is making available to the furnace atmosphere a gas concentration such that equations one and three ($\Delta G$ for equations one and two are not shown on the chart, and is calculated) are shifted to the left preventing oxidation of the iron.

When alloying elements are considered, obviously the additional alloying oxide reaction must also be considered. For example for chrome the fourth additional oxide reaction must also be considered:

4/3 $CR_2+O_2 \rightleftarrows \frac{2}{3}CR_2O_3$ From the standard free energy of formation published curves, this reaction occurs more readily than the equations discussed above.

Figure 2:
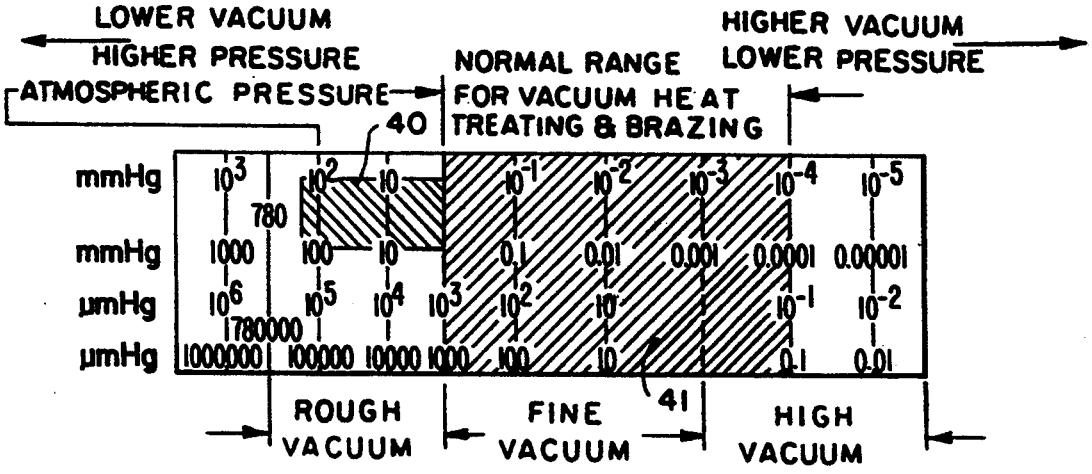

Because the hydrogen content is kept below the lower explosive limit i.e. 4%, there is an overriding control, not shown, which prevents $H_2$ furnace concentration from exceeding 4% of the furnace atmosphere. Should the furnace atmosphere exceed 4%, the furnace is deluged with nitrogen or other inert gas. This is standard, safety conventional technique. The $H_2/H_2O$ required to shift the reactions to the left is so high that a very small amount of water vapor will prevent hydrogen from acting as a "getter" for certain alloys such as titanium, chrome etc. In these instances, the Soft-Vac furnace will be operated at soft vacuum levels without any furnace gas being introduced. That is, the soft vacuum furnace will be operated like a conventional vacuum furnace at high temperature, but at soft vacuum levels when compared to conventional vacuum furnaces. Whatever oxygen is present after purge, will then form oxides with the case. So long as there is a limited amount of oxygen, it may be possible to bright anneal high alloy steel work. Reference should be had to FIG. 2 which shows a cross hatched area 40 indicating the vacuum levels whereat soft vacuum furnace 10 is operated which should be contrasted to the finer vacuum levels indicated by cross hatching 41 which conventional vacuum furnaces are operated.

Thus, the present invention is limited to such processes as hardening tool steel, sintering composite metal parts and brazing. The basic concept is to immerse the work in a reducing atmosphere comprised of an inert gas such as nitrogen or if nitrogen is reactive with the work then argon which has no more than 4% hydrogen. The hydrogen is an oxygen scavenger, but when the partial pressure of oxygen increases as sensed by an oxygen probe, the mass flow rate is increased while the vacuum level remains constant. What this does is to simply remove the gases which have been shifted in equilibrium to an oxide producing reaction and to replace those gases with a fresh supply of reducing gas. The hydrogen content of the fresh supply can be increased but, as noted, this is not going to significantly change the reaction. The primary control is to simply increase the flow rate. Once the oxygen reading drops, the initial flow rate is reestablished.

Oxygen probes have not been used in vacuum applications for the reasons discussed above. With respect to leakage of atmosphere oxygen through the probe, one commercially available probe from the Servomex Company of Norwood, Mass. was found not to deleteriously leak excess oxygen at the vacuum levels under discussion. The temperature consideration however required development of the arrangement disclosed in FIGS. 4 and 5 for the probe to adequately work. More particularly, in an investigation of commercially available oxygen probes, it was determined that their signal output correlated closely to that predicted by the Nernst equation and/or could be correlatable to consistent readings up to a temperature of about 1900° F. Beyond that temperature, consistent readings were not obtainable. Since the furnace operates at temperatures of up to 2350° F., the probe could not be situated in an in situ application. Thus, an ex situ application had to be developed. As a practical matter, ex situ or close coupled oxygen probe installations use small tubing, i.e. $\frac{1}{4}''$-$\frac{3}{8}''$ which functions as a tap through with a small sample stream of furnace atmosphere is pulled from the furnace and then ported back to the furnace or exhausted to atmosphere. The small fittings which connect the tubing to the furnace casing cannot be made gas tight, given furnace vibrations, installation and removal techniques etc. The point is that a very small leak, i.e. in the neighborhood of one thousandth ppm of $O_2$ will distort the probe reading given the size of the gas sample and the very low $H_2/H_2O$ ratios of 1 to 500 to 4,000 required in the control system of the present invention. As a practical matter then, conventional ex situ probe applications will not be satisfactory for the control scheme discussed above.

Figure 5:
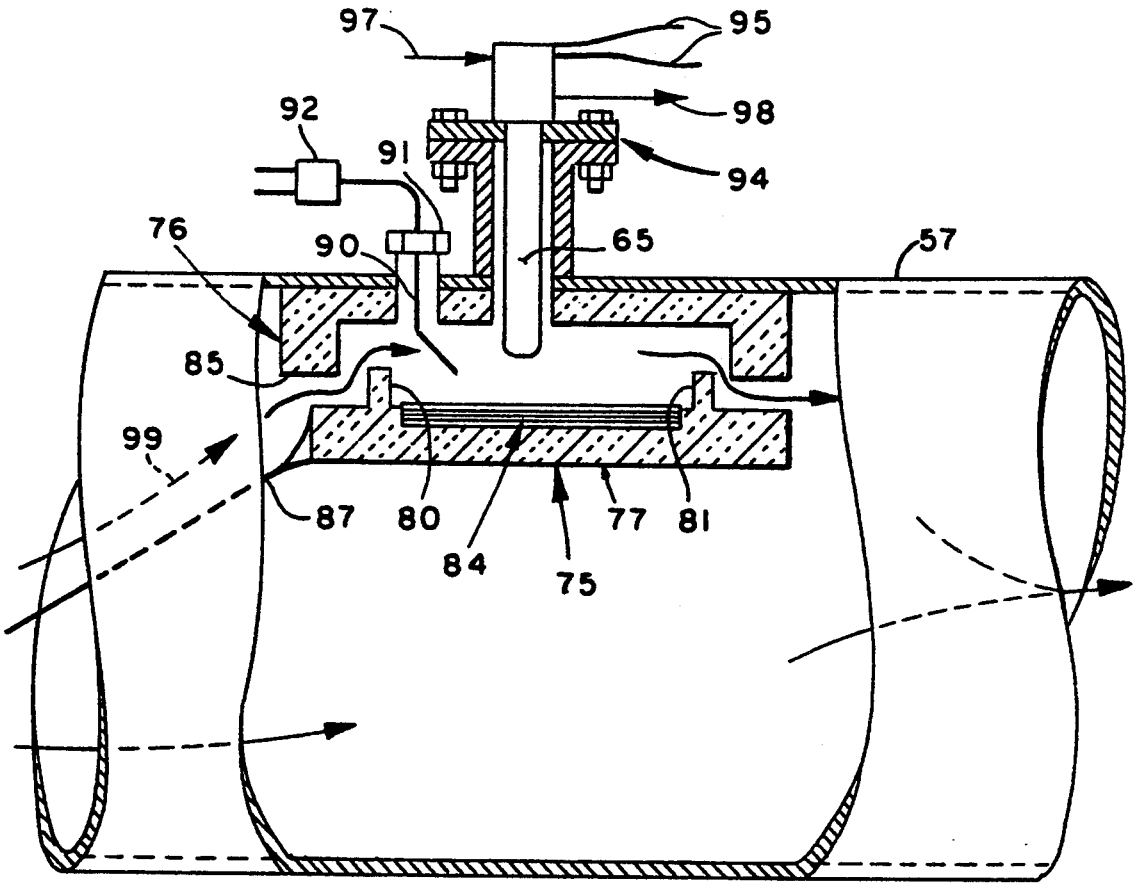
FIG. 5 is a vertically-sectioned, schematic illustration of the oxygen probe enclosure formed in the vacuum duct of the furnace.
Figure 4:
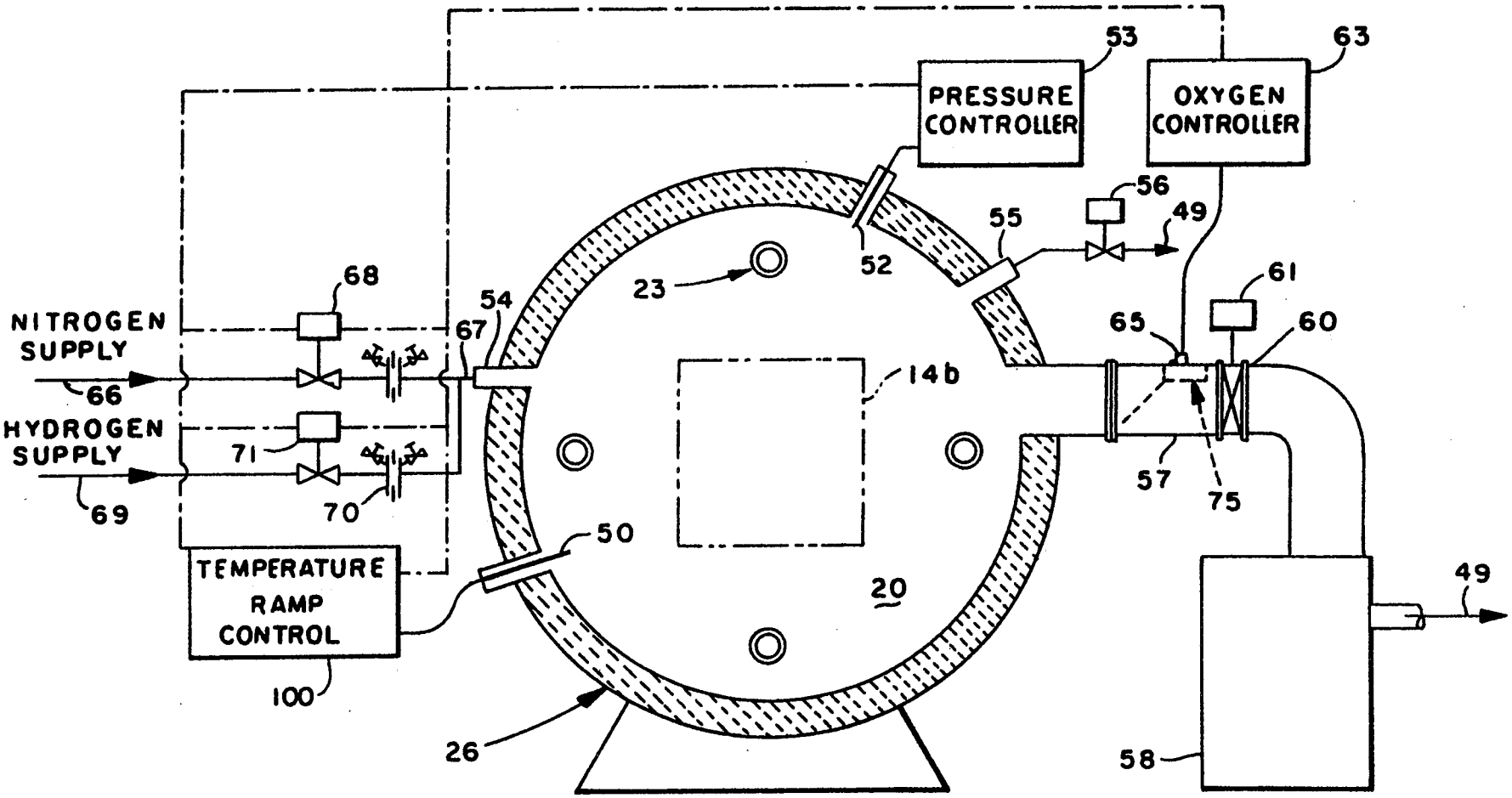
FIG. 4 is a schematic, cross-sectional illustration of the heating chamber of the furnace with the control system of the present invention installed thereon.

Thus the ex situ application developed had to be one in which a large sample of the gas could be analyzed so that if there was a trace leakage (in the 1/1000 ppm $O_2$ range) of oxygen, the sample could be conceivably large enough to absorb the oxygen without significantly distorting the probe reading. Next, the temperature of the sample gas, because of the equilibrium reactions, has to be kept as high as possible so that correlation to the furnace atmosphere at between 2050 to 2350 can be made accurately. If the gas is simply rapidly dropped, the kinetics of the equilibrium reactions produce inconsistent results which could prevent correlatable readings from the probe. Finally, because of the high $H_2/H_2O$ concentrations, an accurate sampling technique must be employed. Taking a small tap of the furnace atmosphere, as is done with close coupled ex situ oxygen probe installations, may not produce a representative furnace atmosphere. The arrangement disclosed in FIGS. 4 and 5 is believed to accomplish both objectives. First, a representative sample is obtained, and secondly, the reading is taken at conditions approximating steady state which can be correlatable to the conditions actually existing within the furnace.

Referring now to FIG. 4, heat chamber 20 is equipped with a vacuum sealed temperature probe 50 and a pressure gage 52 connected to a pressure microprocessor controller 53. Also provided in fluid communication with heat chamber 20 is a gas inlet 54. An atmosphere exhaust duct 55 under the control of a vacuum sealable exhaust damper 56 is also provided. Exhaust duct 55 is open to stack indicated by reference arrow 49 when heating chamber fan 21 is operable when furnace 10 operates as a standard atmosphere furnace, or optionally, when furnace 10 operates to preheat the work. A vacuum duct 57 is in fluid communication with a conventional vacuum pump 58. The vacuum pump is a liquid ring pump with a gas ejection booster and is sized sufficient to draw a pressure in heat chamber 20 anywhere between 1 to 760 torr. Within vacuum duct 57 is a vacuum damper 60 operated by a motor or several motors 61 under the control of a pressure controller 53. Pressure controller 53 senses pressure from pressure gage 52 and controls damper 60 to establish the desired vacuum level within furnace 10. Within vacuum duct 57 is an oxygen probe 65. The millivolt readings from probe 65 are sensed by an oxygen microprocessor controller 63.

A supply of an inert gas, such as nitrogen or argon indicated by reference arrow 66 is in fluid communication through line 67 with gas inlet 54. Flow of nitrogen through line 67 is controlled by a servo actuated inert gas valve 68. A supply of hydrogen indicated by reference arrow 69 is also in fluid communication through line 70 with gas inlet 54. Flow of hydrogen through line 70 is controlled by a servo actuated hydrogen gas valve 71. Nitrogen and hydrogen valves 68, 71 are initially under the control of pressure controller 53 as is vacuum damper motor 61 to admit a predetermined mass flow of nitrogen (during purge, preheating) and a predetermined mass flow of nitrogen and hydrogen (during heat treat heating) at predetermined vacuum levels. Initially the-flow of hydrogen 69 and nitrogen 66 is set by pressure controller 53 so that, for safety regulations compliance, the hydrogen is at 2% of the mass flow rate of nitrogen. When oxygen probe 65 senses a predetermined amount of oxygen content, oxygen controller 63 overrides pressure controller 53 and directly controls nitrogen and hydrogen valves 68, 71 to increase mass flow rate through gas inlet 54. This causes a rise in pressure within heat chamber 20 sensed by pressure gauge 52 and causes pressure controller 53 to regulate vacuum motor 61 to cause vacuum valve 60 to open so that the vacuum level within heat chamber 20 remains at its set point. As indicated above oxygen controller 63 can cause a proportional increase in the mass flow rate of hydrogen 69 so that hydrogen comprises as much as 4 to 5% of the total mass flow of hydrogen and nitrogen entering gas inlet 54. However, the hydrogen is more in the nature of a "trim" gas rather than as an attempt to vary the $H_2/H_2O$ ratio for reasons discussed above.

Referring now to FIG. 5, there is shown an insulated enclosure 75 secured to the inside of vacuum duct 57. The insulated enclosure 75 basically comprises radiation shields 76 to which insulation 77 is fastened and formed as shown at 80, 81 to re-radiate the heat emitted from the electrical heater 84 while also creating a tortuous path functioning in the manner of orifices to produce a slow, steady, nonturbulent flow of furnace atmosphere within enclosure 75. At the entrance end 85 of enclosure 75 is a funneling plate 87 which can be formed as a truncated cone and basically functions as a scoop ensuring the collection of a representative sample from the total flow of furnace atmosphere which is flowing within vacuum duct 57. Within enclosure 75 is thermocouple 90 which extends through a gas-type connection 91 and in turn is connected to a temperature controller 92 which regulates electrical power to heater 84 to maintain the temperature of the furnace gas flowing within insulated enclosure 75 at a temperature of about 1900° F. As shown, oxygen probe 65 is mounted by a collar arrangement 94 to form a gas tight seal and the electrical leads 95 are outside of vacuum duct 57. Reference ambient air indicated by reference numeral 97 is supplied to the interior of oxygen probe 65 and exhausted from oxygen probe 65 as indicated by reference arrow 98 in a conventional manner. Vacuum duct 57 is not insulated and as the furnace atmosphere is drawn by vacuum pump 58 from heat chamber 20 at temperatures up to 2350° F., the temperature immediately drops within vacuum duct 57 to a lower temperature and specifically to a temperature which is less than 1900° F. and conceivably as low as 1300° F. When the gas sample indicated by reference arrow 99 is drawn into insulated enclosure 65, the gas is uniformly heated by electrical heater 84 to a temperature of 1900° F. and the reading correlated by oxygen controller 63 which overrides pressure controller 53 as discussed above. Since the temperature of the gas is not dropped rapidly and the heat-up is at steady state or slow rate conditions, the effect of kinetic reactions on the gas is minimized.

As indicated above, by mounting oxygen probe 65 in an insulated enclosure 75 fitted within vacuum duct 51, should there be an insignificant leakage in the duct connection, the trace amounts of oxygen would be diluted by the total mass flow of furnace atmosphere which would tend to dissipate the deleterious effect otherwise associated with ex situ probe applications. Funnel 87 assures a representative sample and the construction of restrictions 80, 81 or tortuous path assure a steady even flow promoting consistent probe readings.

A typical operating cycle for steel alloys is as follows:

1.) The starting condition is that heat chamber 20 is hot and the work 14 is placed in vestibule 12. Vestibule 12 is purged (either with gas and/or vacuum) and then back filled with a low oxygen content gas.

2.) Work **14*b* is then transferred to heat chamber 20 and it starts to heat. Heat chamber fan 21 is operated and work 14*b* is heated by convection. Pressure in heat chamber 21 can be positive in which case furnace atmosphere will exhaust to stack 49 through atmosphere exhaust 55 or there can be a slight vacuum pulled in heat chamber 20 in which case furnace atmosphere will exhaust to stack 49 through vacuum duct 57. During this time any oils, etc. will be vaporized. As the work continues to heat to a predetermined temperature, the heating chamber is pumped down to avoid oxidation of the work. It is to be noted that during the preheat cycle, there is a temperature point dependent upon the work whereat oxidation of the work will more rapidly occur. Until this temperature is reached, the oxygen probe is not utilized. Further, the temperature at which oxidation may occur, during the preliminary heating of the work, could be at temperatures at which the probe is not responsive. However, it is contemplated that for most heat treat processes, oxygen probe 65 can be operated at atmospheric pressure during preliminary heating of the work in a conventional manner to control purging of heat chamber 20 and achieve high convection heat transfer rates. Purging can be accomplished by inert gas 68 only and vacuum damper 60 in a closed position will permit the furnace atmosphere to circulate through oxygen probe 65**.

3.) When work **14*b* gets to its predetermined oxidizing temperature, heat chamber 20 will be pumped down by actuation of vacuum pump 58. Vacuum damper 60 would be controlled so that the vacuum pulled in heat chamber 20 would be at the range illustrated in FIG. 2 i.e. torr levels anywhere from about 1 to 400 and preferably 1 to 200 torr. FIG. 2** which is extracted from *Metals Handbook* illustrates that this vacuum level range 40 is less than that at which conventional vacuum furnaces are operated. (Because furnace 10 is a standard atmosphere construction there are obviously limits at which a vacuum can be pulled before drawing air into the furnace. Operating the furnace at vacuums as low as 1 torr will not cause excessive leakage of seals, etc. obviously, if door seal construction techniques similar to that used on vacuum furnaces was employed, finer vacuum pressure could be drawn but this would increase furnace costs, maintenance etc.) After the pump down, a reducing mixture of hydrogen and nitrogen would be supplied through lines 67, 70. This inert gas and hydrogen mixture, is supplied to heat chamber 20 at a predetermined constant mass flow rate of anywhere between 400 and 800 standard cubic feet per hour. After purging the flow will be decreased to 50 to 500 standard cubic feet per hour for normal operations. When oxygen probe 65 senses an oxygen content above a predetermined limit which indicates that iron oxide will form on work 14, the flow rate is increased to a value of about 1.1 to 1.5 times the normal flow rate. Optionally, the hydrogen content in this increased flow rate could be increased from 2 to 4 or even 5% of the total gas flow although this is not necessary. When this occurs vacuum damper 60 in vacuum duct 57 is adjusted so that the vacuum pressure remains fairly constant. When the reading from oxygen probe 65 drops, the initial predetermined flow rate is pre-established to minimize gas usage. Oxygen probe 65 measures partial pressure of the oxygen and controls it at about $10^{-11}$ to $10^{-15}$ atmospheres.

Figure 3:
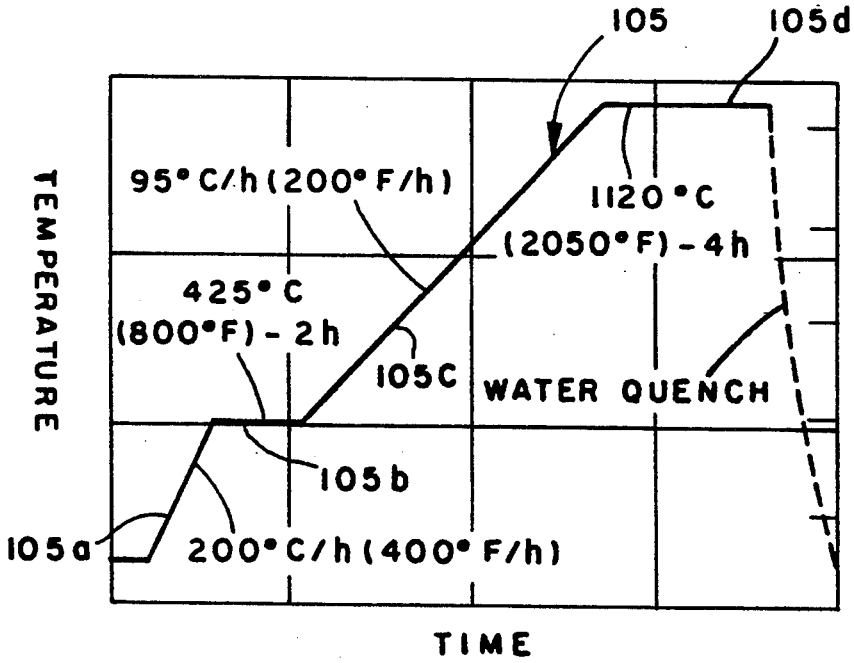
FIG. 3 is a time/temperature graph of a typical, selected heat treat process of the type performed by the furnace controlled by the present invention.

Referring now to FIG. 3, there is shown a typical temperature profile heat processing curve for such metals as tool steel. Thermocouple 50 in heat chamber 20 is connected to a conventional microprocessor based temperature control programmer 100 to control time versus temperature in accordance with a pre-established heat process cycle. This can be an on-off controller or a proportioning or modulating controller or a set point programmer etc. The microprocessor based controllers referred to herein are preferably incorporated into a single master controller such as the Data Vac processor available from Surface Combustion, Inc. or the programmers can be integrated into a network control by a personal computer. This is schematically illustrated in FIG. 4 by connecting pressure controller 53 and oxygen controller 63 into temperature controller 100 which then, in addition to controlling cycle time and temperature, can function as a master controller for all other controllers.

With respect to the heat treat cycle illustrated in FIG. 3 which is for a manganese steel casting, the curve 105 shown therein establishes a relatively high, initial preheat rate designated as 105*a* which can be accomplished at a positive pressure with convection heat or at some slight negative pressure with convection heat. Since the preheat temperature is stabilized at 800° F. i.e. 105*b* oxidation does not occur and is not a problem. At the preheat stabilization level, furnace purging by back filling under vacuum condition is completed and the final heat 105*c* to the heat treating temperature 105*d* occurs with the pressure in the 1 to 400 torr range. During the time the temperature is ramped 105*c* to the heat treating temperature 105*d*, oxygen probe 65 works within its expected ranges. Thermocouple 50 through controller 100 signals to oxygen controller 63 the temperature of the furnace atmosphere gases in heat chamber 20 so that known equilibrium constants and algorithms programmed in oxygen controller 63 will be able to calculate the partial pressure of $O_2$ and adjust gas valves 68, 71 accordingly.

The invention has been described with reference to a preferred embodiment. Obviously, modifications and alterations will occur to others skilled in the art upon reading and understanding the invention. It is intended to include all such modifications and alterations insofar as they come within the scope of the invention.

Having thus defined the invention it is claimed:

1. Apparatus for sensing the oxygen content of the furnace atmosphere of an industrial, hot wall standard atmosphere heat treat furnace as said furnace is operated under a vacuum at temperatures in excess of 2050° F. comprising:

a vacuum duct through which said furnace atmosphere is drawn from said furnace by a vacuum pump, said vacuum duct extending between said pump and said furnace to be at the same pressure as said furnace;

an insulated enclosure within said duct, said enclosure having an inlet and an outlet;

an oxygen probe sealingly secured to said duct and extending within said enclosure;

a heater spaced from said probe and situated within said enclosure for heating furnace atmosphere within said enclosure;

a temperature probe within said enclosure and control means for regulating said heater in response to temperature levels sensed by said temperature probe; and funnel means adjacent said inlet to assure that a representative sample of said gas is drawn under vacuum into said enclosure.

2. Apparatus of claim 1 further including tortuous path means associated with said enclosure to assure steady state flow conditions within said enclosure for consistent probe readings.

3. Apparatus of claim 2 wherein said tortuous path means are adjacent said inlet and said outlet and includes radiation shields maintaining heat from said heater within said enclosure.

4. A hot wall standard atmosphere furnace for heat treating work during a heat treat cycle in which the work is subjected to a vacuum for a portion of said cycle, said furnace including a furnace enclosure; means to supply a heat treating gas to said furnace enclosure and forming a furnace atmosphere therein; means to heat said work within said furnace enclosure; a vacuum pump for drawing a vacuum within said furnace enclosure; a vacuum duct between and in fluid communication with said pump and said furnace enclosure; control means for regulating the vacuum drawn within said furnace enclosure by said vacuum pump, the improvement comprising:

a.) an insulated enclosure within said vacuum duct having an inlet and an outlet;

b.) a funnel shaped baffle within said duct connected to said inlet for directing a portion of said atmosphere within said duct under vacuum into said insulated enclosure;

c.) a heater within said enclosure;

d.) temperature sensing means within said enclosure controlling said heater; and e.) an oxygen sensor probe within said insulated enclosure.

5. The improvement of claim 4 wherein said means to supply said heat treating gas includes means to supply nitrogen and means to supply hydrogen and said control means comprises means for varying the mixture of hydrogen and nitrogen supplied said furnace enclosure in accordance with the oxygen content of the furnace atmosphere sensed by said oxygen sensor while a vacuum is drawn in said furnace enclosure.

6. The improvement of claim 5 further including at least one radiation shield within said insulated enclosure adjacent said inlet whereby the furnace atmosphere drawn through said insulated enclosure is in a quiescent state.

7. The improvement of claim 6 wherein said control means regulates the vacuum drawn by said vacuum pump from 1 to 400 torr within $H_2/H_2O$ ratios of 1 to 500 to 1 to 4,000.

* * * * *